US009162860B2

(12) United States Patent
Nakanishi

(10) Patent No.: US 9,162,860 B2
(45) Date of Patent: Oct. 20, 2015

(54) HYDRAULIC CYLINDER

(75) Inventor: Nobuhiro Nakanishi, Minokamo (JP)

(73) Assignee: KAYABA INDUSTRY CO., LTD., Tokyo (JP)

( * ) Notice: Subject to any disclaimer, the term of this patent is extended or adjusted under 35 U.S.C. 154(b) by 672 days.

(21) Appl. No.: 13/259,916

(22) PCT Filed: Mar. 10, 2010

(86) PCT No.: PCT/JP2010/054471
§ 371 (c)(1),
(2), (4) Date: Sep. 23, 2011

(87) PCT Pub. No.: WO2010/113635
PCT Pub. Date: Oct. 7, 2010

(65) Prior Publication Data

US 2012/0031262 A1 Feb. 9, 2012

(30) Foreign Application Priority Data

Apr. 2, 2009 (JP) ..... 2009-090100

(51) Int. Cl.

| | |
|---|---|
| ***F15B 13/02*** | (2006.01) |
| ***B66F 9/22*** | (2006.01) |
| ***F15B 15/22*** | (2006.01) |
| ***F15B 15/14*** | (2006.01) |

(52) U.S. Cl.
CPC ..... *B66F 9/22* (2013.01); *F15B 15/1457* (2013.01); *F15B 15/22* (2013.01); *F15B 15/223* (2013.01); *F15B 15/226* (2013.01)

(58) Field of Classification Search
CPC ..... F15B 15/22
USPC ..... 91/52, 399, 405, 85 B, 108
See application file for complete search history.

(56) References Cited

U.S. PATENT DOCUMENTS 5,960,696 A * 10/1999 Niwa et al. ..... 92/8

FOREIGN PATENT DOCUMENTS

| | | |
|---|---|---|
| JP | H09-317717 A | 12/1997 |
| JP | 11-230117 | 8/1999 |
| JP | 2000-002207 A | 1/2000 |
| JP | 2003-021113 A | 1/2003 |

OTHER PUBLICATIONS

Machine Translation of Japanese Patent Publication 09-317717.*

* cited by examiner

*Primary Examiner* — Edward Look
*Assistant Examiner* — Daniel Collins
(74) *Attorney, Agent, or Firm* — Rabin & Berdo, P.C.

(57) ABSTRACT

A hydraulic cylinder includes a piston that defines a driving pressure chamber and a cushion pressure chamber within a cylinder tube, an air chamber defined inside a hollow piston rod, an orifice that leads a working fluid in the cushion pressure chamber into the air chamber when the cushion pressure chamber contracts during an extension operation, a check valve that returns a working fluid in the air chamber to the driving pressure chamber when a differential pressure between the air chamber and the driving pressure chamber rises to or above a predetermined value, and a valve housing that houses the check valve. A throttle gap is defined between an outer peripheral surface of the valve housing and an inner peripheral surface of the piston rod, and a working fluid ejected from the orifice during the extension operation flows into the air chamber through the throttle gap.

9 Claims, 3 Drawing Sheets

HYDRAULIC CYLINDER

TECHNICAL FIELD

This invention relates to a direct acting hydraulic cylinder in which a cushion pressure is generated in the vicinity of a stroke end.

BACKGROUND ART

In a typical direct acting hydraulic cylinder (lift cylinder) that is provided in a forklift in order to lift a load, a cushion pressure is generated in the vicinity of a stroke end to absorb an impact occurring when the hydraulic cylinder becomes fully extended and stops.

JP9-317717A, JP2000-2207A, and JP2003-21113A respectively disclose conventional hydraulic cylinders of this type. In these hydraulic cylinders, an air chamber is defined inside a piston rod having a hollow structure, and working oil in a cushion pressure chamber that contracts during an extension operation flows into the air chamber through an orifice.

SUMMARY OF THE INVENTION

In this type of conventional hydraulic cylinder, however, a pressure of a jet of working fluid flowing from the cushion pressure chamber into the air chamber through the orifice is reduced rapidly, and as a result, a jet noise is generated from the orifice.

This invention has been designed in consideration of the problem described above, and an object thereof is to provide a hydraulic cylinder in which generation of a jet noise is suppressed.

This invention is a hydraulic cylinder that performs an extension operation using a pressurized working fluid led into a driving pressure chamber from an external fluid pressure source, including a tubular cylinder tube, a piston that defines the driving pressure chamber and a cushion pressure chamber within the cylinder tube, a piston rod coupled to the piston, an air chamber defined inside the hollow piston rod, an orifice that leads a working fluid in the cushion pressure chamber into the air chamber when the cushion pressure chamber contracts during the extension operation, a check valve that returns a working fluid in the air chamber to the driving pressure chamber when a differential pressure between the air chamber and the driving pressure chamber rises to or above a predetermined value, and a valve housing that houses the check valve. A throttle gap is defined between an outer peripheral surface of the valve housing and an inner peripheral surface of the piston rod, and a working fluid that is ejected from the orifice during the extension operation flows into the air chamber through the throttle gap.

According to this invention, the jet of working fluid flowing into the air chamber from the cushion pressure chamber through the orifice flows into the air chamber through the throttle gap, and therefore a pressure of the jet of working fluid flowing out of the orifice is reduced in stages. As a result, a jet noise generated from the orifice is suppressed.

Details of this invention, as well as other features and advantages thereof, are set forth in the following description of the specification and illustrated in the attached figures.

EMBODIMENTS OF THE INVENTION

An embodiment of this invention will be described below on the basis of the attached figures.

Figure 1:
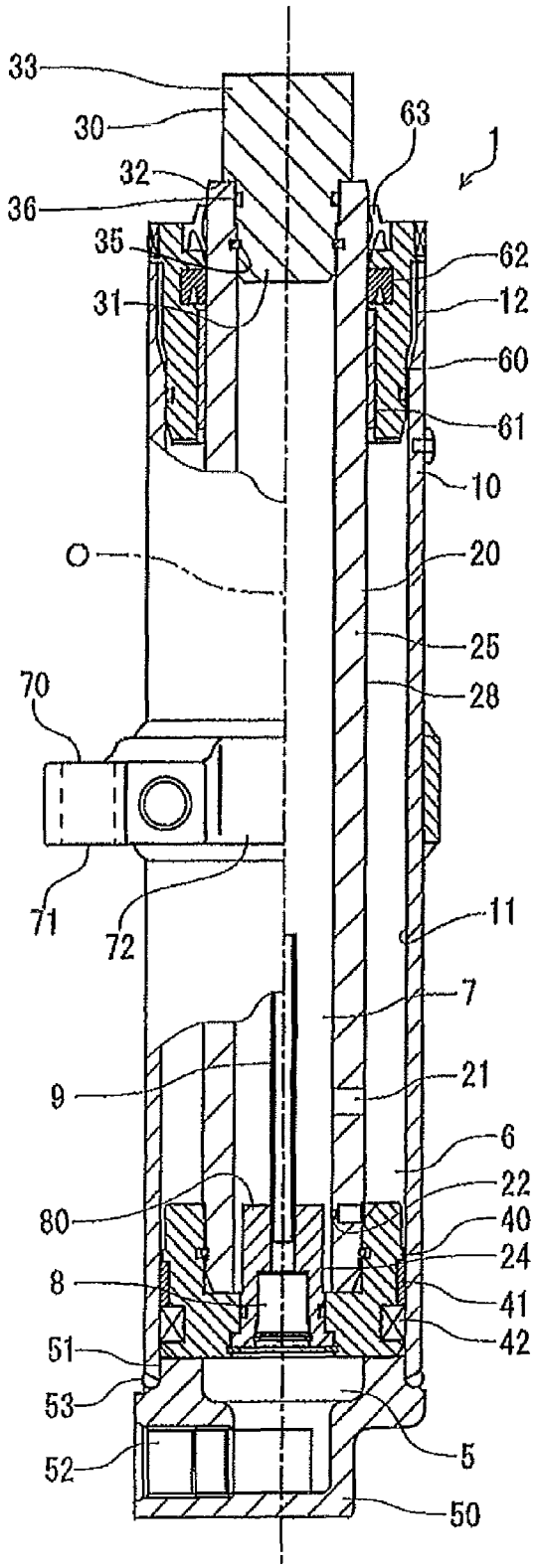
FIG. 1 is a sectional view of a hydraulic cylinder according to an embodiment of this invention.

FIG. 1 is a longitudinal sectional view showing the entirety of a hydraulic cylinder (an oil pressure cylinder) 1. The hydraulic cylinder 1 is used as a lift cylinder for raising and lowering a load of a forklift, for example.

The single acting hydraulic cylinder 1 includes a cylinder tube 10 supported on a vehicle body, and a piston rod 20 coupled to a fork for raising and lowering a load. A driving pressure chamber 5 is defined by a piston 40 provided in a base end portion of the piston rod 20.

The hydraulic cylinder 1 is installed in the vehicle body such that a central axis O thereof extends in a vertical direction.

A pressurized working fluid supplied from a fluid pressure source, not shown in the figure, is led into the driving pressure chamber 5 through a pipe. When a pressure of the working fluid led into the driving pressure chamber 5 increases, the piston rod 20 moves in the direction of the central axis O (i.e. upward) relative to the cylinder tube 10, and thus an extension operation is performed. When the pressure of the working fluid led into the driving pressure chamber 5 decreases, on the other hand, the piston rod 20 is moved downward by its own weight and a load applied thereto, and thus a contraction operation is performed. FIG. 1 shows a state in which the hydraulic cylinder 1 is maximally contracted such that the piston rod 20 is at a stroke end.

Oil is used in the hydraulic cylinder 1 as the working fluid, but a working fluid such as a replacement aqueous fluid, for example, may be used instead of oil.

Figure 2:
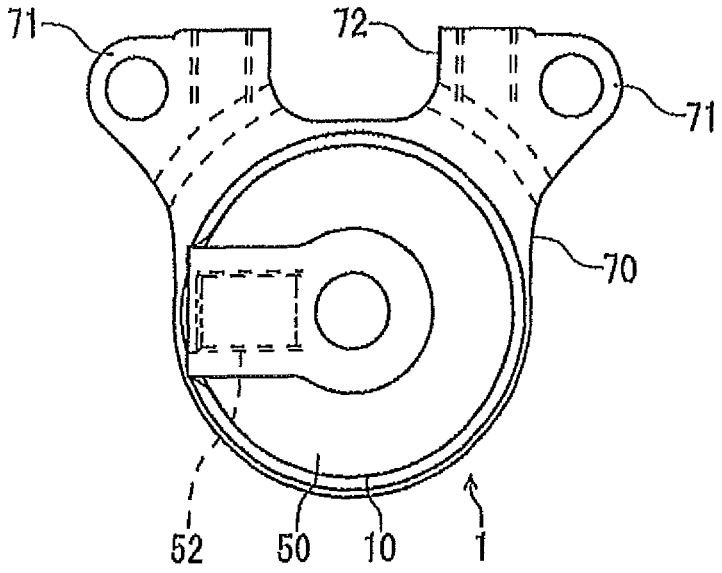
FIG. 2 is a plan view of the hydraulic cylinder according to an embodiment of this invention.

FIG. 2 is a plan view showing the hydraulic cylinder 1 from below. The cylinder tube 10 is cylindrical, and an end block 50 is joined to a lower end opening portion thereof.

The driving pressure chamber 5 is defined between the piston 40 and the end block 50 inside the cylinder tube 10.

The end block 50 includes a cylindrical spigot portion 51, and the spigot portion 51 is fitted to an inner peripheral surface 11 of the cylinder tube 10. A base end portion of the cylinder tube 10 is fixed to the end block 50 by a welding portion 53. A supply/discharge port 52 is formed in the end block 50, and the pipe extending from the fluid pressure source, not shown in the figure, is connected to the supply/discharge port 52.

A cylindrical cylinder head 60 is joined to an upper portion open end of the cylinder tube 10. A screw portion 12 is formed on an upper portion of the inner peripheral surface 11 of the cylinder tube 10, and the cylinder head 60 is screwed and fastened to the screw portion 12.

A cylindrical bearing 61 is interposed on an inner periphery of the cylinder head 60, and the piston rod 20 is fitted to the inner periphery of the cylinder head 60 to be capable of sliding via the bearing 61.

The piston 40 is coupled to the base end portion of the piston rod 20. A bearing 41 is interposed on an outer periphery of the piston 40, and the piston 40 contacts the inner peripheral surface 11 of the cylinder tube 10 to be free to slide via the bearing 41.

The bearing 61 of the cylinder head 60 contacts an outer peripheral surface 28 of the piston rod 20 to be free to slide, and the bearing 41 of the piston 40 contacts the inner peripheral surface 11 of the cylinder tube 10 to be free to slide. Hence, the piston rod 20 is supported so as to perform a translating motion in the central axis O direction of the cylinder tube 10.

An air chamber 7 is defined inside the hollow piston rod 20. A working fluid (cushioning oil) and air are charged into the air chamber 7.

The piston rod 20 includes a cylindrical hollow rod 25, and a rod end cap 30 that closes an upper portion open end of the hollow rod 25. Thus, a maximum volume is secured in the air chamber 7 defined inside the piston rod 20.

The block-shaped rod end cap 30 includes a spigot portion 31 fitted to an inner periphery of the hollow rod 25, an annular step portion 32 that contacts an upper end surface of the hollow rod 25, and a bracket portion 33 coupled to a partner side member.

The spigot portion 31 is formed in a columnar shape that is fitted to the inner periphery of the hollow rod 25.

The hollow rod 25 is formed using a pipe material (a steel tube) that extends in a vertical cylinder shape. To secure a required strength in the piston rod 20, an appropriate material is selected and heat treatment such as high frequency hardening is performed thereon.

A snap ring 35 that retains the rod end cap 30 and a seal ring 36 that tightly seals the air chamber 7 are interposed between the hollow rod 25 and the spigot portion 31.

The snap ring 35 is provided as a latch member for retaining the rod end cap 30 in the hollow rod 25. The snap ring 35 is fitted between an annular groove opened in an outer peripheral surface of the spigot portion 31 and an annular groove opened in an inner peripheral surface of the hollow rod 25, and latches the rod end cap 30 to prevent the rod end cap 30 from moving upward in the central axis O direction relative to the hollow rod 25.

Note that this invention is not limited to this constitution, and instead, means for joining the hollow rod 25 to the rod end cap 30 using a screw fitting, a welding fitting, and so on, for example, may be provided as a latch member for retaining the rod end cap 30 in the hollow rod 25.

By joining the rod end cap 30 to the hollow rod 25 via the snap ring 35, a corresponding assembly operation is simplified. Further, since an operation to weld the rod end cap 30 to the hollow rod 25 or the like is not required, welding sputtering and oxidized scale do not occur, and therefore an improvement in quality is achieved.

The annular step portion 32 formed on the rod end cap 30 contacts the upper end surface of the hollow rod 25, thereby latching the rod end cap 30 so that the rod end cap 30 cannot move downward in the central axis O direction relative to the hollow rod 25.

The load exerted on the piston rod 20 is supported in a site where the step portion 32 of the rod end cap 30 contacts the upper end surface of the hollow rod 25. As a result, an excessive load is prevented from acting on the snap ring 35, and sufficient attachment strength is secured in relation to the rod end cap 30.

The bracket portion 33 is formed in a bracket shape corresponding to the partner side member (not shown) to which the bracket portion 33 is coupled. In actuality, the rod end cap 30 is provided in a plurality of types corresponding to forklift models or specifications. Thus, the hollow rod 25 of the piston rod 20 can be used in common with partner sides having different specifications, thereby facilitating management of the components constituting the piston rod 20 and reducing manufacturing costs.

A stay 70 is provided on an outer periphery of the cylinder tube 10, and the cylinder tube 10 is fixed to the vehicle body side of the forklift via the stay 70. The annular stay 70 is fitted to an outer peripheral surface of the cylinder tube 10 and joined thereto by welding.

The stay 70 includes a pair of flange portions 71, and is fastened to the vehicle body side by two bolts (not shown) penetrating the flange portions.

The stay 70 includes a recessed portion 72 provided between the respective flange portions 71, and a pipe (not shown) for leading the working fluid into the driving pressure chamber 5 passes through the recessed portion 72.

The driving pressure chamber 5 and a cushion pressure chamber 6 are defined inside the cylinder tube 10 by the piston 40.

Packing 42 is interposed on the outer periphery of the piston 40, and by causing the packing 42 to contact the inner peripheral surface 11 of the cylinder tube 10 to be free to slide, a tight seal is formed between the driving pressure chamber 5 and the cushion pressure chamber 6.

A main seal 62 and a dust seal 63 that contact the outer peripheral surface 28 of the piston rod 20 to be free to slide are interposed on the inner periphery of the cylinder head 60. The cushion pressure chamber 6, to be described below, is tightly sealed by the main seal 62. The dust seal 63 prevents infiltration of dust and the like.

Figure 3:
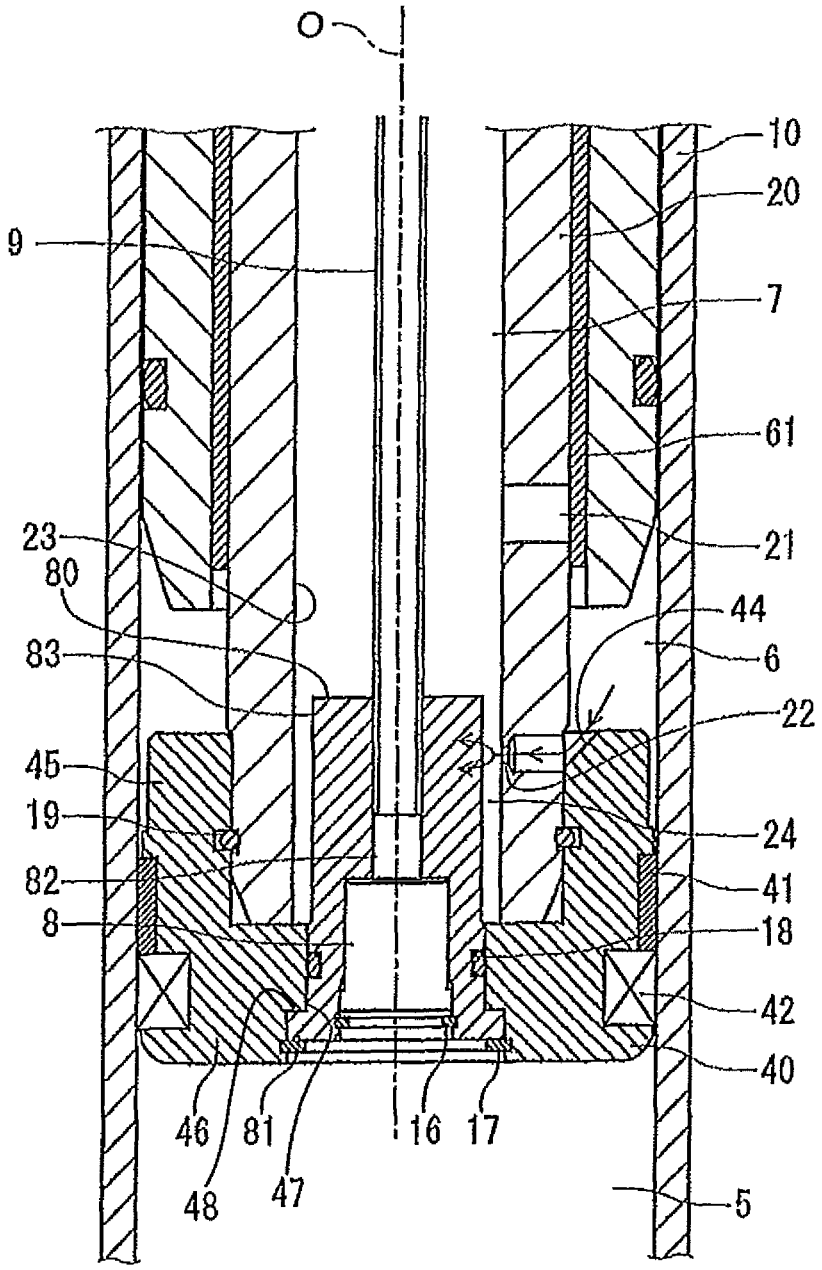
FIG. 3 is a partially enlarged sectional view of the hydraulic cylinder according to an embodiment of this invention.

FIG. 3 is a sectional view taken around the piston 40 and the cylinder head 60 of the hydraulic cylinder 1 and showing a state in which the hydraulic cylinder 1 is extended.

A port 21 and an orifice 22 are formed in the piston rod 20. The cushion pressure chamber 6 is connected to the air chamber 7 by the port 21 and the orifice 22.

A check valve 8 is interposed in the piston 40, and surplus working fluid accumulated in the air chamber 7 is returned to the driving pressure chamber 5 through the check valve 8. A valve body (a ball) of the check valve 8 is pushed against a seat, by a biasing force of a spring, not shown in the figure, and when a differential pressure between the air chamber 7 and the driving pressure chamber 5 exceeds a predetermined valve opening pressure, the valve body separates from the seat.

A return pipe 9 projecting upward from the piston 40 is provided in the air chamber 7, and the return pipe 9 is connected to an inflow port of the check valve 8.

The piston 40 is formed in a closed-end cylindrical shape, and includes a cylindrical piston outer ring portion 45 that is fitted to the outer periphery of the piston rod 20 and a disc-shaped piston bottom portion 46 on which a lower end of the piston rod 20 is seated.

An inner periphery of the piston outer ring portion 45 is fitted to the outer periphery of the piston rod 20, and a snap ring 19 is interposed between the two members. The snap ring 19 is fitted between an annular groove opened in an inner peripheral surface of the piston outer ring portion 45 and an annular groove opened in the outer peripheral surface of the piston rod 20, and latches the piston rod 20 so that the piston rod 20 cannot move upward in the central axis O direction relative to the piston 40.

A tapered portion 44 that widens in a conical surface shape is formed on the inner periphery of the piston outer ring portion 45, and the working fluid in the cushion pressure chamber 6 is led to the orifice 22 via the tapered portion 44.

A valve housing 80 is incorporated into the piston bottom portion 46. The check valve 8 is housed in the valve housing 80.

A snap ring 16 is fitted into an annular groove formed in an inner periphery of the valve housing 80 in order to retain the check valve 8.

An attachment hole 47 is formed in a central portion of the piston bottom portion 46. An outer periphery of the cylindrical valve housing 80 is fitted into the attachment hole 47.

A seal ring 18 is interposed between the attachment hole 47 and the valve housing 80. A tight seal is formed between the driving pressure chamber 5 and the air chamber 7 by the seal ring 18.

An annular step portion 48 is formed on the piston bottom portion 46, and an annular collar portion 81 is formed on the valve housing 80. By causing the collar portion 81 to contact the step portion 48, the valve housing 80 is latched and thereby prevented from moving upward in the central axis O direction relative to the piston 40.

A snap ring 17 is fitted into an annular groove formed in the attachment hole 47 to retain the valve housing 80. By causing the snap ring 17 to contact a lower end surface of the valve housing 80, the valve housing 80 is latched and thereby prevented from moving downward in the central axis O direction relative to the piston 40.

A fluid pressure of the driving pressure chamber 5, which is received by the valve housing 80, is supported in a site where the collar portion 81 contacts the step portion 48 of the piston 40. As a result, an excessive load is prevented from acting on the snap ring 17, and sufficient attachment strength is secured in the valve housing 80.

An attachment hole 82 is formed in a central portion of the valve housing 80. A lower end portion of the cylindrical return pipe 9 is press-fitted and attached to the attachment hole 82. As a result, the return pipe 9 is provided upright on the piston 40 and disposed along the central axis O.

When the piston rod 20 approaches the stroke end during the extension operation of the hydraulic cylinder 1, the port 21 is closed by the bearing 61 such that the working fluid in the cushion pressure chamber 6 flows into the air chamber 7 through the orifice 22. The orifice 22 applies resistance to the flow of working fluid flowing out of the cushion pressure chamber 6, leading to an increase in a pressure (to be referred to hereafter as a cushion pressure) of the cushion pressure chamber 6, and therefore the piston rod 20 is decelerated. As a result, an impact occurring when the piston rod 20 reaches the stroke end, as shown in FIG. 1, is absorbed.

An annular throttle gap 24 is defined between an outer peripheral surface 83 of the valve housing 80 and the inner peripheral surface 23 of the piston rod 20. The throttle gap 24 communicates with a lower portion of the air chamber 7.

The outer peripheral surface 83 of the valve housing 80 is disposed to face the orifice 22 opened in the piston rod 20. The orifice 22 extends in a radial direction of the valve housing 80 orthogonal to the central axis O.

Hence, when the piston rod 20 approaches the stroke end during the extension operation of the hydraulic cylinder 1, the working fluid in the cushion pressure chamber 6 flows into the air chamber 7 through the orifice 22 and the annular throttle gap 24.

Next, an operation of the hydraulic cylinder 1 will be described.

During the extension operation of the hydraulic cylinder 1, the piston 40 and the piston rod 20 are moved upward in the central axis O direction by the pressure of the working fluid led into the driving pressure chamber 5, and as a result, a load is lifted by the fork that moves in conjunction therewith.

A small amount of the working fluid leaks out from the outer periphery of the piston 40 into the cushion pressure chamber 6, and when a liquid level of the working fluid accumulated in the cushion pressure chamber 6 and the air chamber 7 exceeds an upper end of the return pipe 9, the working fluid flows down into the return pipe 9. When the pressure of the air chamber 7 rises above a predetermined value, the check valve 8 opens such that the surplus working fluid accumulated in the return pipe 9 is returned to the driving pressure chamber 5. The liquid level of the working fluid accumulated in the cushion pressure chamber 6 and the air chamber 7 is thus maintained in the vicinity of the upper end of the return pipe 9, and the working fluid is held at an amount required to realize a cushioning effect.

When the piston rod 20 approaches the stroke end during the extension operation of the hydraulic cylinder 1, the port 21 is closed by the bearing 61 such that the working fluid in the cushion pressure chamber 6 flows into the air chamber 7 through the orifice 22 and the annular throttle gap 24. The orifice 22 and the annular throttle gap 24 apply resistance to the flow of working fluid flowing out of the cushion pressure chamber 6, leading to an increase in the cushion pressure of the cushion pressure chamber 6, and therefore the piston rod 20 is decelerated. As a result, the impact occurring when the piston rod 20 reaches the stroke end is absorbed.

As shown by arrows in FIG. 3, a jet of working fluid flowing into the air chamber 7 from the cushion pressure chamber 6 through the orifice 22 impinges on the outer peripheral surface 83 of the valve housing 80 and then flows toward the air chamber 7 thereabove while bifurcating to either side around the outer peripheral surface 83 of the valve housing 80. By applying resistance to the jet of working fluid passing through the orifice 22 in this manner, a pressure of the jet is reduced in stages, and therefore a jet noise generated from the orifice 22 is suppressed.

During a contraction operation of the hydraulic cylinder 1, the pressure of the working fluid led into the driving pressure chamber 5 decreases, and therefore the piston rod 20 is moved downward by its own weight and the load applied thereto. Thus, the contraction operation is performed. At this time, the working fluid that flowed into the air chamber 7 from the cushion pressure chamber 6 is returned to the cushion pressure chamber 6 through the port 21 and the orifice 22.

In this embodiment, as described above, the hydraulic cylinder 1, which performs the extension operation using the pressurized working fluid led into the driving pressure chamber 5 from the external fluid pressure source, includes the tubular cylinder tube 10, the piston 40 that defines the driving pressure chamber 5 and the cushion pressure chamber 6 within the cylinder tube 10, the piston rod 20 coupled to the piston 40, the air chamber 7 defined inside the hollow piston rod 20, the orifice 22 that leads the working fluid in the cushion pressure chamber 6 into the air chamber 7 when the cushion pressure chamber 6 contracts during the extension operation, the check valve 8 that returns the working fluid in the air chamber 7 to the driving pressure chamber 5 when the differential pressure between the air chamber 7 and the driving pressure chamber 5 rises to or above a predetermined value, and the valve housing 80 that houses the check valve 8. The throttle gap 24 is defined between the outer peripheral surface 83 of the valve housing 80 and the inner peripheral surface 23 of the piston rod 20, and the working fluid ejected from the orifice 22 during the extension operation flows into the air chamber 7 through the throttle gap 24.

On the basis of this constitution, the jet of working fluid flowing into the air chamber 7 from the cushion pressure chamber 6 through the orifice 22 flows into the air chamber 7 through the throttle gap 24, and therefore the pressure of the jet of working fluid flowing out of the orifice 22 is reduced in stages. As a result, a jet noise generated from the orifice 22 is suppressed.

In this embodiment, the cylindrical return pipe 9 standing upright on the piston is further provided, and the surplus working fluid accumulated in the air chamber 7 is returned to the driving pressure chamber 5 through the return pipe 9 and the check valve 8. Further, the piston 40 includes the piston outer ring portion 45 fitted to the outer periphery of the piston rod 20, and the piston bottom portion 46 on which the lower end of the piston rod 20 is seated. The cylindrical valve housing 80 projects from the central portion of the piston bottom portion 46, and the lower end portion of the return pipe 9 is fitted and attached to the inner periphery of the valve housing 80.

On the basis of this constitution, as shown by the arrows in FIG. 3, the jet of working fluid flowing into the air chamber 7 from the cushion pressure chamber 6 through the orifice 22 impinges on the outer peripheral surface 83 of the valve housing 80 but does not impinge directly on the return pipe 9, and therefore a reduction in the attachment strength of the return pipe 9 caused by the jet is avoided.

The return pipe 9 is press-fitted and attached to the attachment hole 82 in the valve housing 80, and therefore a corresponding assembly operation is simplified. Since an operation to weld the return pipe 9 or the like is not required, welding sputtering and oxidized scale do not occur, and therefore an improvement in quality is achieved.

This invention is not limited to the embodiment described above, and may be subjected to various modifications and amendments within the scope of the technical spirit thereof, such modifications and amendments being included within the technical scope of the invention.

With respect to the above description, the contents of Japanese Patent Application No. 2009-90100, with a filing date of Apr. 2, 2009 in Japan, are incorporated herein by reference.

Exclusive properties or features encompassed by this invention are as claimed below.

The invention claimed is:

1. A hydraulic cylinder that performs an extension operation using a pressurized working fluid led into a driving pressure chamber from an external fluid pressure source, comprising:

a tubular cylinder tube;

a piston that defines the driving pressure chamber and a cushion pressure chamber within the cylinder tube;

a piston rod coupled to the piston;

an air chamber defined inside the hollow piston rod;

an orifice that leads a working fluid in the cushion pressure chamber into the air chamber when the cushion pressure chamber contracts during the extension operation;

a check valve that returns a working fluid in the air chamber to the driving pressure chamber when a differential pressure between the air chamber and the driving pressure chamber rises to or above a predetermined value;

a valve housing that houses the check valve, and a cylindrical return pipe that stands upright in the valve housing, the return pipe having an outside diameter that is smaller than an outside diameter of the valve housing, the cylinder return pipe affixed to the valve housing, wherein a throttle gap is defined between an inner peripheral surface of the piston rod and an outer peripheral surface of the valve housing that is disposed to face an open end of the orifice, the throttle gap being formed so as to extend in a perpendicular direction from the outer peripheral surface of the valve housing relative to a central axis of the cylinder tube, and a working fluid ejected from the orifice during the extension operation flows into the air chamber through the throttle gap.

2. The hydraulic cylinder as defined in claim 1, wherein a surplus working fluid accumulated in the air chamber is returned to the driving pressure chamber through the return pipe and the check valve, the piston comprises:

a piston outer ring portion fitted to an outer periphery of the piston rod; and a piston bottom portion on which a lower end of the piston rod is seated, the valve housing is cylindrical and projects from a central portion of the piston bottom portion, and a lower end portion of the return pipe is attached to an inner periphery of the valve housing.

3. The hydraulic cylinder as defined in claim 1, wherein the throttle gap is disposed to face the open end of the orifice under a portion of the air chamber that is defined between the inner peripheral surface of the piston rod and an outer peripheral surface of the return pipe.

4. The hydraulic cylinder as defined in claim 1, wherein the throttle gap is formed to have an annular shape.

5. The hydraulic cylinder as defined in claim 1, wherein the throttle gap is formed to suppress generation of a jet noise.

6. The hydraulic cylinder as defined in claim 1, wherein the piston rod is hollow.

7. The hydraulic cylinder as defined in claim 1, wherein no diameter of the cylindrical return pipe is equal to any diameter of the valve housing.

8. The hydraulic cylinder as defined in claim 1, wherein in a direction perpendicular to a direction that the piston rod moves along to perform the extension operation, a length of the throttle gap is smaller than that of the air chamber.

9. A hydraulic cylinder that performs an extension operation using a pressurized working fluid led into a driving pressure chamber from an external fluid pressure source, comprising:

a tubular cylinder tube;

a piston that defines the driving pressure chamber and a cushion pressure chamber within the cylinder tube;

a piston rod coupled to the piston;

an air chamber defined inside the piston rod;

an orifice that leads a working fluid in the cushion pressure chamber into the air chamber when the cushion pressure chamber contracts during the extension operation;

a check valve that returns a working fluid in the air chamber to the driving pressure chamber when a differential pressure between the air chamber and the driving pressure chamber rises to or above a predetermined value;

a valve housing that houses the check valve; and a cylindrical return pipe that stands upright in the valve housing, the return pipe having an outside diameter that is smaller than an outside diameter of the valve housing, wherein a throttle gap is defined between an inner peripheral surface of the piston rod and an outer peripheral surface of the valve housing that is disposed to face an open end of the orifice, the throttle gap being formed so as to extend in the perpendicular direction from the outer peripheral surface of the valve housing relative to a central axis of the cylinder tube, the throttle gap being disposed to face the open end of the orifice under a portion of the air chamber that is defined between the inner peripheral surface of the piston rod and an outer peripheral surface of the return pipe, and a working fluid ejected from the orifice during the extension operation flows into the air chamber through the throttle gap.

* * * * *